US007051531B2

(12) United States Patent
Tiemann

(10) Patent No.: US 7,051,531 B2
(45) Date of Patent: May 30, 2006

(54) FLOW CONTROL BODY

(75) Inventor: Peter Tiemann, deceased, late of Witten (DE); by Iris Oltmanns, legal representative, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 199 days.

(21) Appl. No.: 10/729,108

(22) Filed: Dec. 5, 2003

(65) Prior Publication Data

US 2004/0118124 A1 Jun. 24, 2004

(30) Foreign Application Priority Data

Dec. 19, 2002 (EP) ..... 02018598

(51) Int. Cl.
*F02C 7/18* (2006.01)

(52) U.S. Cl. ..... 60/752; 60/754; 60/757; 60/755

(58) Field of Classification Search ..... 60/752, 60/754, 755, 756, 757, 758, 760
See application file for complete search history.

(56) References Cited

U.S. PATENT DOCUMENTS

| | | | | |
|---|---|---|---|---|
| 5,027,604 | A * | 7/1991 | Krueger | 60/752 |
| 5,363,654 | A * | 11/1994 | Lee | 60/752 |
| 5,391,052 | A | 2/1995 | Correia et al. | |
| 6,047,552 | A * | 4/2000 | Gross et al. | 60/752 |
| 6,276,142 | B1 * | 8/2001 | Putz | 60/752 |
| 6,676,370 | B1 * | 1/2004 | Tiemann | 415/116 |

FOREIGN PATENT DOCUMENTS

| | | |
|---|---|---|
| EP | 1 247 943 A1 | 10/2002 |
| WO | WO 98/13645 | 4/1998 |
| WO | WO 99/09354 | 2/1999 |

* cited by examiner

*Primary Examiner*—Ted Kim

(57) ABSTRACT

In order to develop a flow control body (6) for separate control of a cooling fluid inflow and a cooling fluid outflow for combustion chambers with a closed cooling system for turbines such that a simplified cooling fluid flow control is made possible in the combustion chamber wall, it is proposed with the invention that the flow control body (6) has a non-rotationally symmetrical cross-sectional shape (7) in a flow control section.

6 Claims, 3 Drawing Sheets

FLOW CONTROL BODY

CROSS REFERENCE TO RELATED APPLICATIONS

This application claims priority to the European application No. 02018598.9 EP, filed Dec. 19, 2002 under the European Patent Convention and which is incorporated by reference herein in its entirety.

FIELD OF THE INVENTION

The invention relates to a flow control body for separate control of a cooling fluid inflow and a cooling fluid outflow for combustion chambers with a closed cooling system for turbines.

BACKGROUND OF THE INVENTION

Combustion chambers with a closed cooling system for turbines can have walls made, for example, of a hollow tile construction. Known constructions of this kind comprise a central fixing element, a circular feed system and a circular discharge system for a cooling fluid. In such an arrangement, the circular feed system and the circular discharge system for the cooling fluid are separated by means of a rotationally symmetrical flow control body. Because of the intercrossing feed and discharge systems this known form of construction necessitates a very complex design of the outer wall of the combustion chamber.

SUMMARY OF THE INVENTION

Proceeding from this prior art, the object of the invention is to develop a flow control body of the type referred to above such that a simplified construction of the outer wall of the combustion chamber is possible. Also to be specified is an improved flow control structure for supplying cooling fluid in a combustion chamber with a closed cooling system for a turbine.

This object is achieved in that it is proposed with the invention for a flow control body of the type referred to above that the flow control body has a cross-section with a non-rotationally symmetrical cross-sectional shape in a flow control section.

Due to the departure from the rotationally symmetrical cross-sectional shape in known flow control bodies, a concentric means of control of the cooling fluid inflow and outflow and therefore a crossing of the flow paths can be avoided. With a flow control body with a non-rotationally symmetrical cross-sectional shape, the cross-section can be realized in such a way that it embodies flow control paths in, for example, four segments, said flow control paths passing adjacent to one another through the outer wall.

According to a development of the invention it is provided that the cross-section is realized in such a way that a circumcircle placed around this is subdivided into at least two separate parts by the contour of the cross-section. The inflow and outflow for a cooling fluid can then take place in these separate parts.

The flow control body can thus have a figure-of-eight shaped cross-section. Separate flow control paths are then embodied in each case in the interior of the two loops of the figure of eight. Further flow control paths can be embodied together with a circular element surrounding the figure of eight between the waists of the figure of eight and the circular element. In this way a total of four mutually separate flow paths can be implemented. Two of the total of four flow paths can be used for example for the cooling fluid feed system, for example the two flow paths embodied in the interior of the loops of the figure of eight, while two more can be used for the control of discharging cooling fluid, for example the areas embodied between the surrounding circular wall structure and the two waist areas of the figure of eight. However, other non-symmetrical cross-sectional shapes such as, for example, a double figure of eight, a ring containing a star within it, or similar, are also possible.

According to a further development of the invention the flow control body has passage openings in the flow control section to allow the passage of flowing cooling fluid. Thus, with a cross-section embodied in the shape of a figure of eight, for example, the flow control body can have passage openings in the area of the loops of the figure of eight. In this way the fluid flow in one direction, for example the inflow, can be routed through the flow control body, while the other flow, for example the outflow, can be routed past the flow control body. This leads to a very good separation of the two flow paths.

Also specified with the invention is a flow control structure for routing cooling fluid in a combustion chamber with a closed cooling system for a turbine which contains a flow control body according to the invention. With a flow control structure of this type, the above described advantages can be achieved in a combustion chamber with a closed cooling system for a turbine.

In one development the flow control structure can have a shower insert which is connected for flow engineering efficiency to a cooling fluid feed system routed through the flow control body and provided with a plurality of fine passage openings, said shower insert directing the cooling fluid entering for impingement cooling onto an impingement plate. In such an arrangement the flow control structure according to the invention can be used for impingement cooling. Depending on the geometrical shape of the impingement plate the shower insert will have a corresponding geometrical shape as well as a distribution of the passage openings.

At the same time, according to a further development of the flow control structure according to the invention, the shower insert can be implemented in the shape of a plate, whereby the flow control body has, on its side facing the shower insert, a folded-over edge on which the plate-shaped shower insert is supported, and whereby the shower insert is connected to the flow control body. In this way cooling fluid routed through passage openings in the flow control body can reach the shower insert and, after passing through this, the impingement plate via a closed space which is defined by the folded-over edge of the flow control body. Recirculated flow control fluid flows around the edge of the flow control body and is thus returned to the flow control cross-section, there to the areas provided for the routing of the outflow. The connection between the flow control body and the shower insert can be effected via a receptacle in the central area of the flow control body into which a screw bolt introduced through this can be screwed in to fix the shower insert in position. Here, the receptacle preferably has a surrounding collar onto which the screw bolt presses the shower insert in the assembled state. In this way the shower insert is attached to the flow control body securely and in an essentially sealing manner by means of a simple and detachable fixing.

According to a further development of the invention it is provided that the flow control body and the shower insert connected to this are inserted in a connecting piece into a receptacle space disposed in the connecting piece, whereby the flow control body has structures, for example stud-like elevations, which engage with the connecting piece in order to transmit a force flow. In this arrangement the connecting piece serves to connect the flow control structure to a combustion chamber wall structure in an area in which passage openings for feeding in or discharging cooling fluid are provided in the combustion chamber wall. As a result of the formation of the receptacle space in which the combination of flow control body and shower insert is inserted, a defined space is specified in which the cooling fluid flow takes place. In this case, according to a development of the invention the impingement plate can be placed on top of an edge of the connecting piece surrounding the receptacle space and welded to this. In this way a self-contained system for controlling the cooling fluid flow is obtained. Cooling fluid flowing in through an opening in the combustion chamber wall reaches the receptacle space of the connecting piece, is directed via the flow control body in the direction of the shower insert onto the impingement plate and exits the receptacle space, again routed through the flow control body, through an exit opening implemented in the combustion chamber wall. In order to gain access through the welded-on impingement plate to the screw bolt located underneath this and connecting the shower insert to the flow control body, an access opening which can be closed by means of a plug is provided in the impingement plate in the area underneath which the screw bolt is disposed.

According to a further development of the invention, in the case of the flow control structure the flow control body with a figure-of-eight shaped cross-section is inserted into a circular opening of the connecting piece, whereby the circular opening surrounds the figure-of-eight shaped cross-section in the manner of a circumcircle and the circular opening is inserted together with the figure-of-eight shaped cross-section of the flow control body into a circular recess in a combustion chamber wall in a sealing manner, whereby the flow control body subdivides the circular recess into four segments, of which two are connected to a cooling fluid feed system and two to a cooling fluid discharge system.

BRIEF DESCRIPTION OF THE DRAWINGS

Further advantages and features of the invention result from the following description of an exemplary embodiment with reference to the attached figures, in which.

DETAILED DESCRIPTION OF INVENTION

Figure 1:
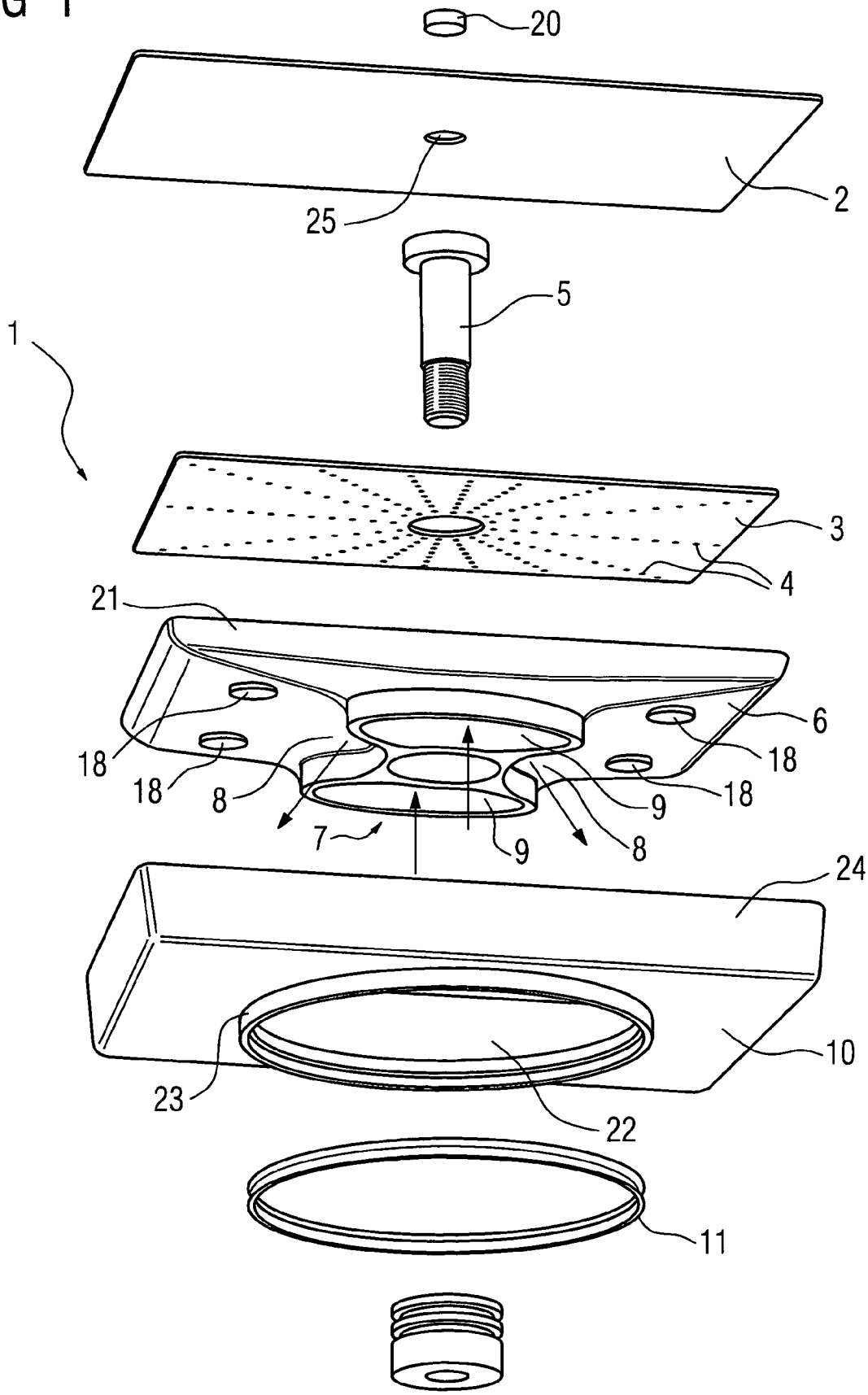
FIG. 1 shows an exploded view of a flow control structure with a flow control body according to the invention.

FIG. 1 shows an exploded view of a flow control structure 1 according to the invention. The flow control structure is composed of an impingement plate 2, a shower insert 3 provided with passage openings 4, a flow control body 6 and a connecting piece 10. Shower insert 3, flow control body 6 and connecting piece 10 are held together by means of a bolt 5. The connecting piece 10 has a circular connecting opening 22 for connecting to a combustion chamber wall, whereby the connecting opening 22 has a surrounding collar 23. A seal 11 is inserted to complete the connection to the combustion chamber wall. In the central area the flow control body 6 has a receptacle with a surrounding collar 19 (see FIG. 2) through which the bolt 5 is introduced. In the assembled flow control structure the bolt 5 presses the shower insert 3 tightly against the surrounding collar. The plate-shaped shower insert 3 is then supported with its edge on a folded-over edge 21 of the flow control body 6. The impingement plate 2 for its part is supported on an edge 24 of the connecting piece 10 delimiting a receptacle space embodied in the connecting piece 10 and is welded to this edge. In order to allow access to the bolt 5 even when the impingement plate 2 is welded onto the connecting piece 10, the impingement plate 2 has, in the area above the bolt, an access opening 25 which can be closed by means of a plug 20.

The flow control body 6 has a flow control cross-section 7 which deviates from a rotationally symmetrical shape. The flow control cross-section 7 is constructed in a figure-of-eight shape and in combination with the circular connecting opening in the connecting piece 10 forms a total of four flow control areas. Inlets 9 are implemented in the two loops of the figure eight, and inlets 8 are implemented in the areas between the waists of the figure eight and the circular connecting opening of the connecting piece 10. The connecting bolt 5 projects through the center of the figure-of-eight shaped flow control cross-section. In the area of the loops of the figure eight the flow control body 6 has passage openings through which cooling fluid penetrates into a flow control space formed between the folded-over edge 21 and the shower insert 3 supported on it. Through these passage openings, which form the inlets, supplied cooling fluid reaches the shower insert 3 and via this, in a way still to be described below, the impingement plate 2. Also to be seen disposed on the side of the flow control body 6 opposite the shower insert 3 are studs 18 by means of which the flow control body 6 engages with the connecting piece 10 in order to transmit a force flow.

Figure 2:
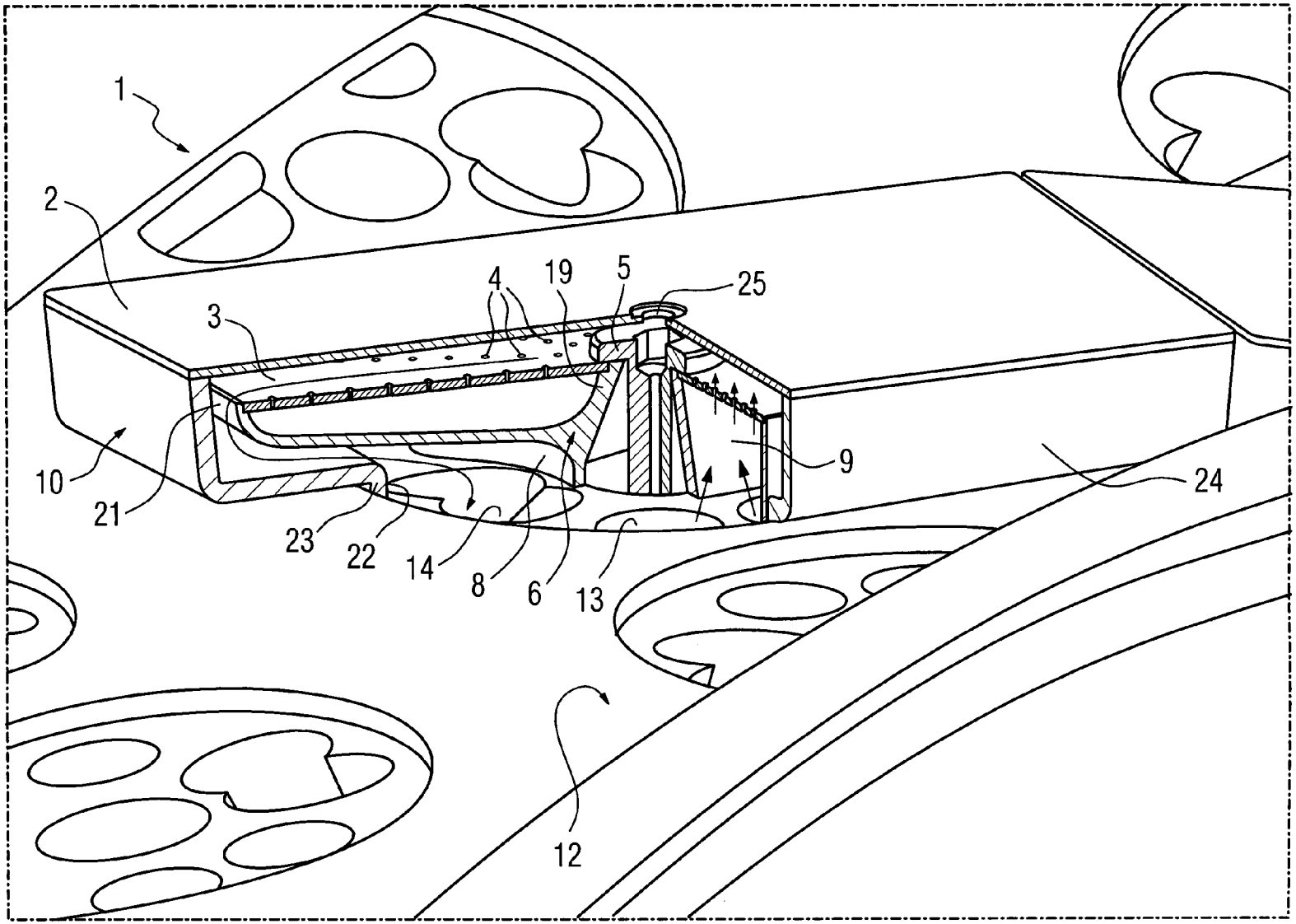
FIG. 2 shows a perspective cutaway view of a flow control structure integrated into a combustion chamber wall.

FIG. 2 shows a perspective cutaway view of the flow control structure 1 according to the invention integrated in a combustion chamber wall 12. The flow path of a cooling fluid through the flow control structure is indicated by arrows. Through feed passages 13, cooling fluid passes through the inlets 9 of the flow control body 6 to the shower insert 3 and reaches the impingement plate 2 via the openings 4. From there the cooling fluid is routed into the gap implemented between the impingement plate 2 and the shower insert 3 around the front side of the flow control body 6 to the outlets 8. From there the cooling fluid passes through a discharge system 14, then again through the combustion chamber wall 12 and is discharged.

Figure 3:
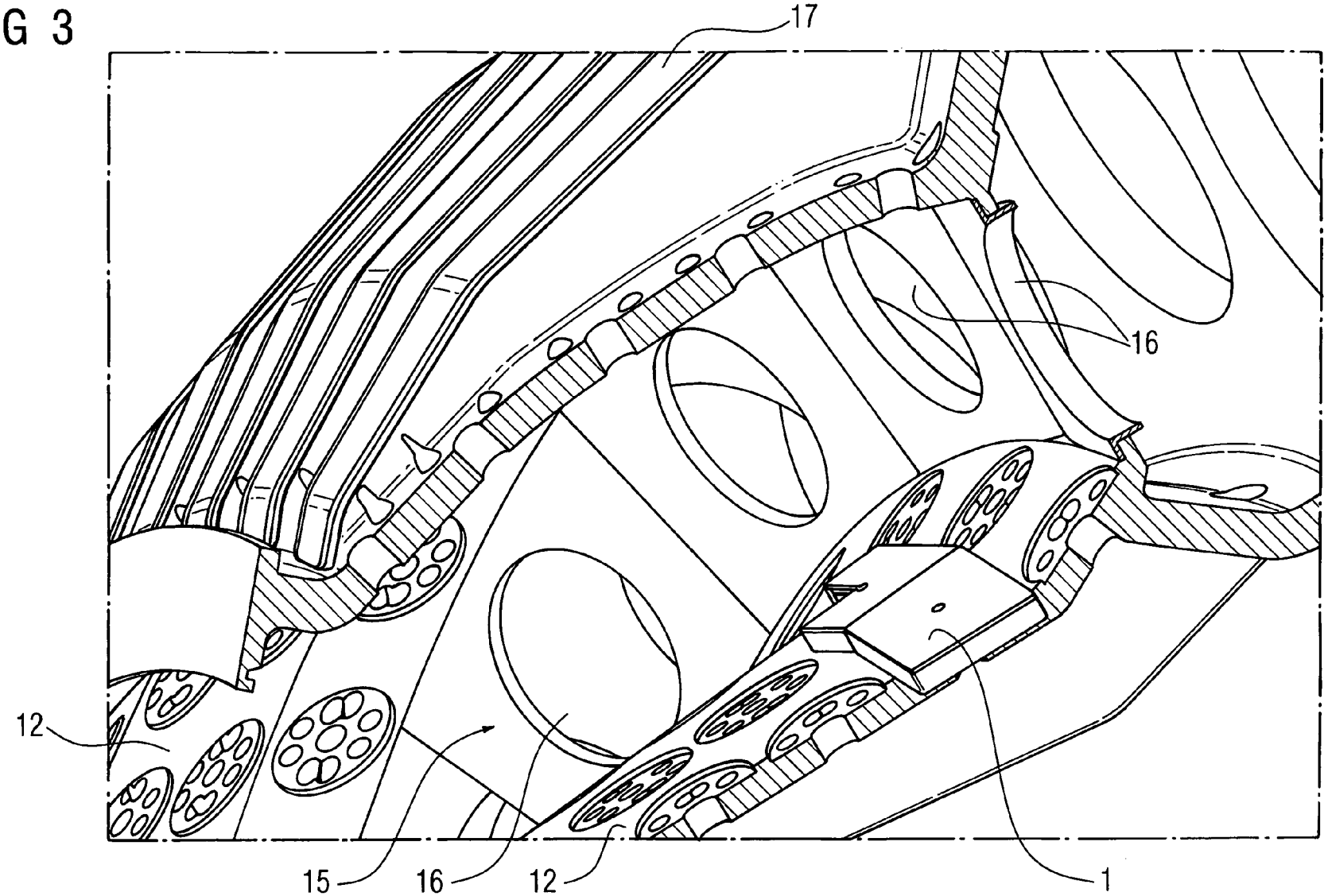
FIG. 3 shows a three-dimensional view of a section of a combustion chamber with integrated flow control structures according to the invention.

FIG. 3 shows a three-dimensional cutaway view of a combustion chamber 15 which is lined on its wall 12 with a plurality of flow control structures 1. In the fully assembled state the flow control structures 1 cover the entire interior area of the combustion chamber 15 in the manner of tiles.

Also to be seen are burner openings 16 through which the ignited gas enters the combustion chamber 15.

Finally the figure shows that drainage channels 17 are mounted on the outside of the combustion chamber wall 12, into which drainage channels the cooling fluid flowing through the flow control structures passes through the discharge passages 14 and is discharged in the axial direction along the combustion chamber.

The exemplary embodiment shown serves to explain the invention and is not restrictive.

The invention claimed is:

1. A flow control structure for cooling fluid control in a combustion chamber with a closed cooling system for a turbine, comprising:

a flow control body for separate control of a cooling fluid inflow and a cooling fluid outflow for combustion chambers with a closed cooling system for turbines, wherein the flow control body has a cross-section with a non-rotationally symmetrical cross-sectional shape in a flow control section and the flow control body with a figure-of-eight shaped cross-section is inserted into a circular opening of the connecting piece, the circular opening surrounds the figure-of-eight shaped cross-section in the manner of a circumcircle, and the circular opening is inserted together with the figure-of-eight shaped cross-section of the flow control body in a circular recess in a combustion chamber wall in a sealing manner, the flow control body subdivides the circular recess into four segments, of which two are connected to a cooling fluid feed system and two to a cooling fluid discharge system and the flow control body and a shower insert are inserted in a connecting piece in a receptacle space disposed in the connecting piece, whereby the flow control body has structures that engage with the connecting piece in order to transmit a force flow.

2. The flow control structure according to claim 1, wherein it has a shower insert which is connected for flow engineering efficiency to a cooling fluid feed system routed through the flow control body and provided with a plurality of fine passage openings, said shower insert directing the cooling fluid entering for impingement cooling onto an impingement plate.

3. The flow control structure according to claim 2, wherein the shower insert is embodied as a plate shape, the flow control body has, on its side facing the shower insert, a folded-over edge on which the shower insert is supported, and the shower insert is connected to the flow control body.

4. The flow control structure according to claim 3, wherein the flow control body has, in a central area, a receptacle provided with a surrounding collar, into which receptacle, for the purpose of fixing the shower insert in position, a screw bolt introduced through this can be screwed, whereby in the assembled state the screw bolt presses the shower insert onto the collar.

5. The flow control structure according to claim 1, wherein an impingement plate is placed on top of an edge of the connecting piece surrounding the receptacle space and is welded to this edge, whereby the impingement plate has an access opening which can be closed by means of a plug in the area underneath which a screw bolt is disposed.

6. The flow control body according to claim 1, further comprising a plurality of passage openings in the flow control section to allow the passage of flowing cooling fluid.

* * * * *